US010711777B2

(12) United States Patent
Couto et al.

(10) Patent No.: US 10,711,777 B2
(45) Date of Patent: Jul. 14, 2020

(54) SUCTION ACOUSTIC FILTER FOR COMPRESSOR

(71) Applicant: Whirlpool S.A., Sao Paulo (BR)

(72) Inventors: Paulo Rogerio Carrara Couto, Joinville (BR); Flavio Jorge Haddad Kalluf, Joinville (BR); Dietmar Erich Bernhard Lilie, Joinville (BR); Evandro Luiz Lange Pereira, Joinville (BR)

(73) Assignee: Embraco Industria De Compressores E Solucoes EM Refrigeracao LTDA, Joinville (BR)

( * ) Notice: Subject to any disclaimer, the term of this patent is extended or adjusted under 35 U.S.C. 154(b) by 372 days.

(21) Appl. No.: 15/558,261

(22) PCT Filed: Mar. 18, 2016

(86) PCT No.: PCT/BR2016/050059
§ 371 (c)(1),
(2) Date: Sep. 14, 2017

(87) PCT Pub. No.: WO2016/145503
PCT Pub. Date: Sep. 22, 2016

(65) Prior Publication Data

US 2018/0045195 A1 Feb. 15, 2018

(30) Foreign Application Priority Data

Mar. 19, 2015 (BR) ..... 1020150062087
Feb. 12, 2016 (BR) ..... 1020160030510

(51) Int. Cl.
*F04B 49/22* (2006.01)
*F04B 39/00* (2006.01)
*F01N 1/16* (2006.01)

(52) U.S. Cl.
CPC ..... *F04B 49/22* (2013.01); *F01N 1/163* (2013.01); *F04B 39/0055* (2013.01); *F04B 39/0061* (2013.01)

(58) Field of Classification Search
CPC .. F04B 49/22; F04B 39/0055; F04B 39/0061; F01N 1/163
(Continued)

(56) References Cited

U.S. PATENT DOCUMENTS 4,109,751 A * 8/1978 Kabele ..... F01N 1/089 181/229
5,208,429 A * 5/1993 Field ..... F02M 35/1222 181/229
(Continued)

FOREIGN PATENT DOCUMENTS

BR 10 2014 007254 3 3/2014
WO WO 2009/157594 A1 12/2009
(Continued)

*Primary Examiner* — Jeremy A Luks
(74) *Attorney, Agent, or Firm* — Harrington & Smith

(57) ABSTRACT

The present invention relates to the technological field of compressors and components and/or devices for compressors. Problem to be solved: The current state of the art includes cooling system of dual evaporation and/or dual suction. On the solutions already existing, the selection of one among the two evaporation/suction lines is done by high complexity constructive mechanisms. Problem resolution: The invention in question aims to simplify the construction of a selection mean of one among two evaporation/suction lines. For so, is revealed a suction acoustic filter for reciprocating compressor which integrates an automatic valve coupled to the inlet way of the suction acoustic filter and a valve of a way is coupled to the inlet way of the suction acoustic filter, being said automatic valve and said valve of
(Continued)

a way acting selectively reciprocating, where the valve opening of a way ends up opening the automatic valve.

9 Claims, 3 Drawing Sheets

(58) Field of Classification Search
USPC ..... 181/238, 239, 229, 254; 417/312
See application file for complete search history.

(56) References Cited

U.S. PATENT DOCUMENTS

| | | | | |
|---|---|---|---|---|
| 5,531,078 | A | 7/1996 | Day et al. | 62/199 |
| 6,358,019 | B1 * | 3/2002 | Iversen | F04B 39/0072 181/403 |
| 7,316,291 | B2 * | 1/2008 | Thomsen | F04B 39/0061 181/229 |
| 7,959,416 | B2 * | 6/2011 | Bosco, Jr. | F04B 39/0072 181/229 |
| 9,732,741 | B2 * | 8/2017 | Rodrigues | F04C 29/065 |
| 2002/0185333 | A1 * | 12/2002 | Svendsen | F04B 39/0061 181/229 |
| 2003/0136928 | A1 * | 7/2003 | Kordon | F16K 11/044 251/65 |
| 2003/0150670 | A1 * | 8/2003 | Svendsen | F04B 39/0061 181/262 |
| 2009/0038329 | A1 * | 2/2009 | Alvarenga | F04B 39/0066 62/296 |

FOREIGN PATENT DOCUMENTS

| | | |
|---|---|---|
| WO | WO 2011/134030 A2 | 11/2011 |
| WO | WO 2013/016790 A1 | 2/2013 |

* cited by examiner

SUCTION ACOUSTIC FILTER FOR COMPRESSOR

The present invention relates to a new embodiment of acoustic suction filter reciprocating compressor, and more particularly, to an acoustic filter suction to reciprocating compressor used in refrigeration systems and particularly refrigeration systems provided with the least two independent lines of evaporation/suction.

In general, the suction acoustic filter for reciprocating compressor is provided with a simplified skilled means to select one of the two (or multiple) independent lines of lines evaporation/suction of the refrigeration system.

BACKGROUND OF THE INVENTION

As is knowledge of technicians on the matter, the current state of the art is composed of various cooling system configurations. Among these configurations, and based on the scope of the subject invention are the following ones that comprise at least two independent lines of evaporation/suction and therefore at least two evaporators for working at different pressures acting in different temperature ranges.

In this scenario, particular reference is made to Patent PCT/BR2011/000120 where are described at least two refrigeration systems settings of at least two independent lines of evaporation/suction. One of these embodiments foresees the use of a reciprocating compressor whose compression mechanism (in particular, the entire valve assembly) is specially modified to have two separate lines evaporator/suction, and comprise expedients to select/enable of temporary mode, only one of the two lines of evaporation/suction. Another embodiment provides the use of a reciprocating compressor comprising a compression mechanism is essentially conventional and comprises the addition of a fluid selector device (three-way valve/two positions) able to select, on a temporary basis, one out of the two lines of evaporation/suction, this allowing the fluid communication with the compression mechanism.

Additionally, although checks that the Patent Document BR1020140072543 describes and illustrates at least one embodiment said fluid selector device originally designed on Patent PCT/BR2011/000120. Furthermore, is expected also the possibility of installing said fluid selector device inside the suction acoustic filter reciprocating compressor.

On the other hand, it has also knowledge of the refrigeration system described in Patent document U.S. Pat. No. 5,531,078, which are provided two rows of evaporation/suction derived arranged evaporators in series and arranged to configure a fractional evaporation system, where part of the refrigerant (portion which has exchanged heat in the first evaporator review) can be returned to the compressor without the need to move the second evaporator. In the embodiment described in that document patenting U.S. Pat. No. 5,531,078, selecting one among the two rows of evaporation/suction is directly performed by means of a valve "ON/OFF", which in pressure differential function, cooperates with a check valve.

According to the embodiment proposed on Patent document U.S. Pat. No. 5,531,078, "ON/OFF" valve, which is arranged externally to the compressor is directly linked to the line of evaporation/suction of the first evaporator, whereas the check valve, which is disposed inside the compressor, it is linked both to the line of evaporation/suction of the first evaporator (so as to obstruct its counter flow towards the line of evaporation/suction of the second evaporator) and the line of evaporation/suction of the second evaporator (to prevent or enable its flow into the compressor compression mechanism). Thus, according to Patent document U.S. Pat. No. 5,531,078, simple switching of the operating state of the valve "ON/OFF" is able to select, directly or indirectly, from the two lines of evaporation/suction.

However, and as is common for an expert skilled in the art see, the cooling system described in patenting document U.S. Pat. No. 5,531,078 presents technical aspects for improvement/optimization, among which you can highlight: i) the use of two lines evaporation/hermetic suction, which impairs the lubricating oil return; and ii) the technical difficulty of mounting a check valve directly on a pipe where pressurized fluid circulates.

It is based on the teachings of the patent documents PCT/BR2011/000120 and BR1020140072543, and aspects for improvement/optimization in existing Patent document U.S. Pat. No. 5,531,078, which comes to the present invention.

OBJECTIVE OF THE PRESENT INVENTION

Therefore, it is the main objective of the subject invention provide a means of selecting one of two (or multiple) evaporation lines/suction simplistically, similar to that shown in Patent document U.S. Pat. No. 5,531,078, but optimally/improved, and can be applied in cooling systems as described the patent PCT/BR2011/000120 and BR1020140072543.

It is therefore aim of the subject invention said selection of one of two rows of evaporation/suction is performed in the acoustic filter of the reciprocating compressor suction.

SUMMARY OF THE INVENTION

All the objectives mentioned above are achieved by means of the suction acoustic filter for reciprocating compressor, which comprises the object of the subject invention.

Said suction acoustic filter for reciprocating compressor comprises at least two input ways, at least one outlet via at least one main chamber arranged between the two input channels and output channels. Said main chamber comprises a volume of common sound attenuation to at least two input ways and at least one exit way.

In accordance with the subject invention, at least one automatic valve is arranged cooperating in relation to one of the acoustic filter entries process of suction and at least one valve from at least one way is arranged cooperating relative to each other of acoustic suction filter entries routes In particular, said automatic valve and said one-way valve acting to selectively alternately, and opening the one-way valve culminates in closing the automatic valve and the closing of the one-way valve culminates in the valve opening machine.

The said one-way valve may comprise a two-position two-way valve preferably controlled by a solenoid.

Said automatic valve may comprise a pressure differential valve, or a normally-open type plate valve. In this second option, said acoustic filter may further comprise at least one stop end-of-course disposed within the main chamber so as to cooperate with at least one of the two valves According to the preferred embodiment of the subject invention, the automatic valve is housed in a lower portion of the suction filter According to an alternative embodiment of the invention in question, said acoustical filter further comprises at least one mounting structure disposed within the main chamber, it is apt to allow mounting at least one of the two valves.

BRIEF DESCRIPTION OF THE DRAWINGS

The acoustic filter suction to reciprocating compressor now revealed becomes detailed detail based on the figures listed below, including.

DETAILED DESCRIPTION OF THE INVENTION

Figure 1:
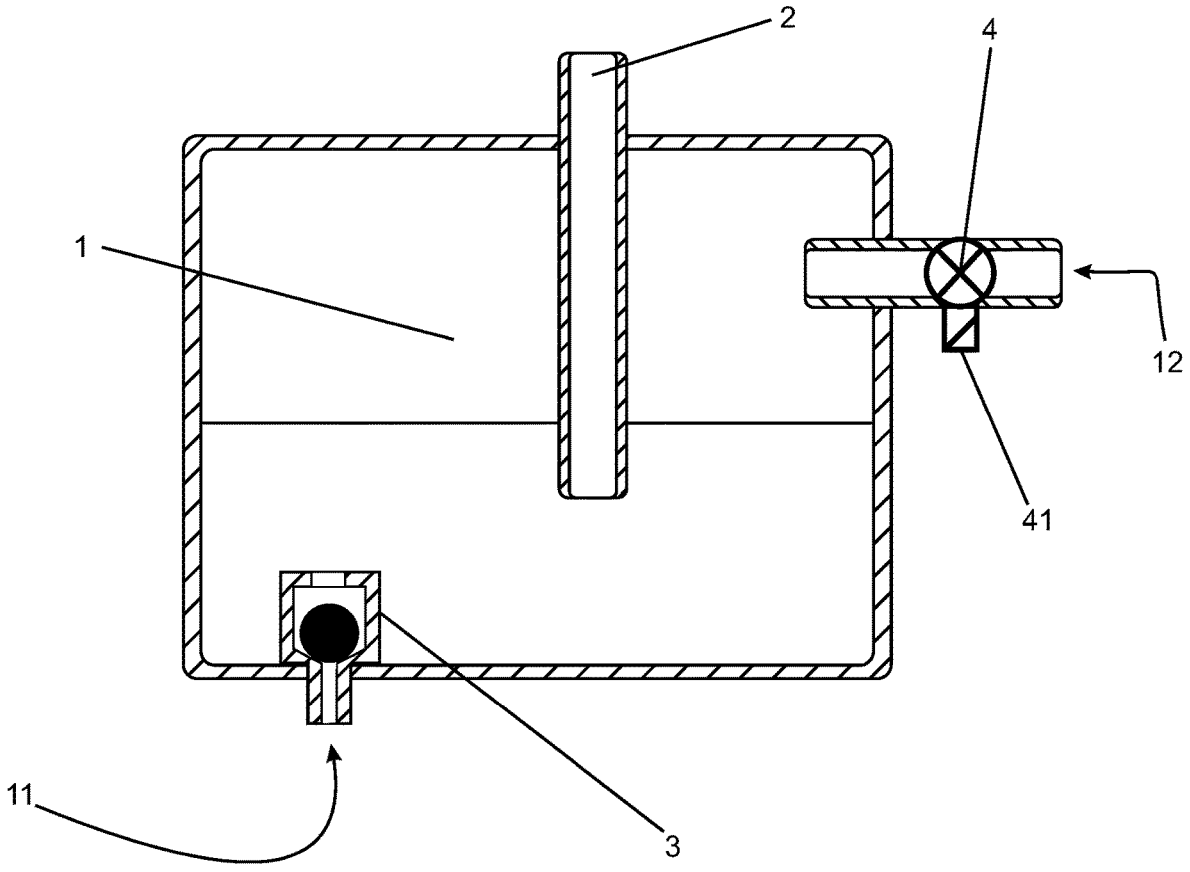
FIG. 1 illustrates in schematic section, a first constructive option preferred of the subject invention object.
Figure 2:
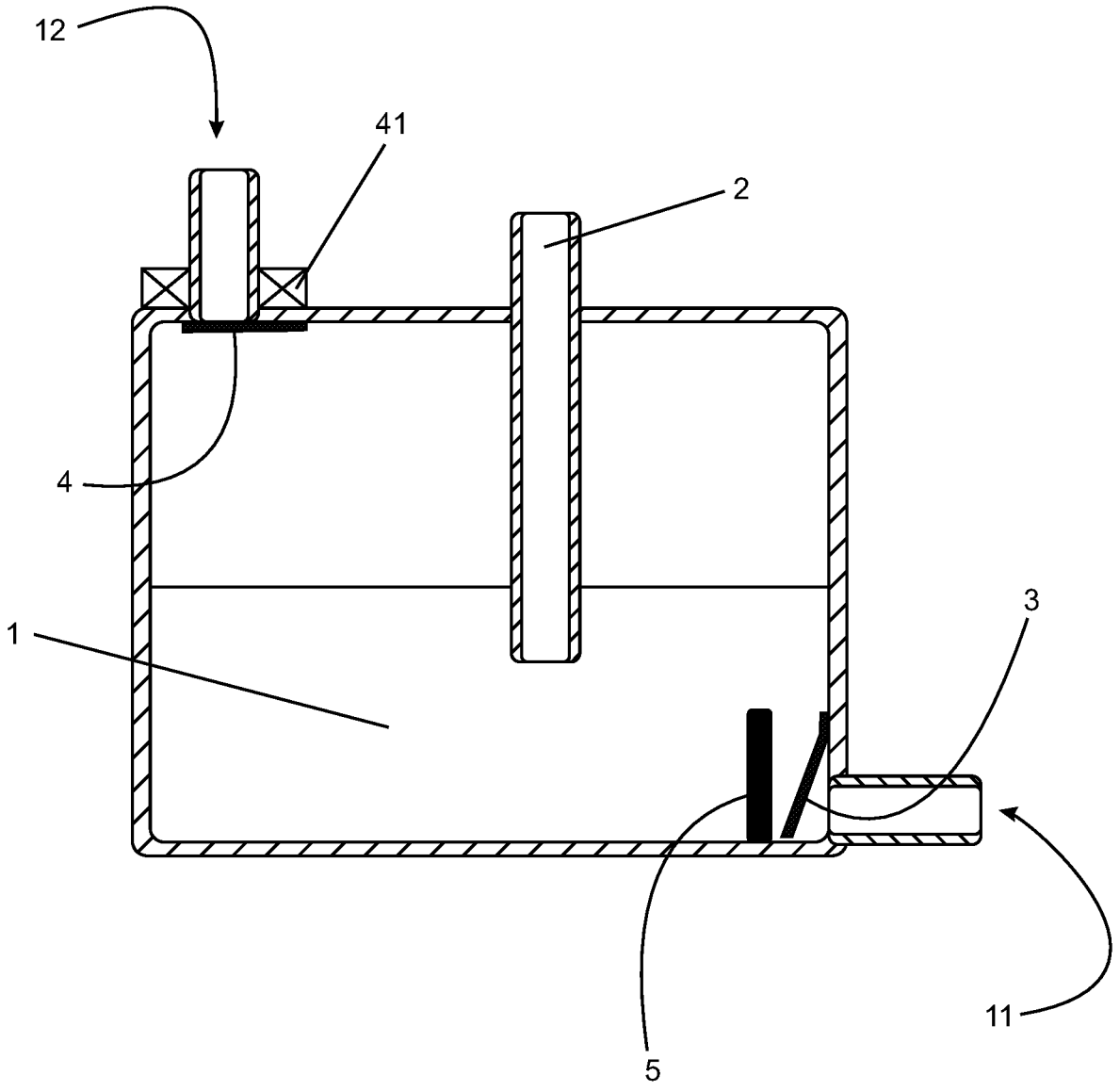
FIG. 2 illustrates in schematic section, a second constructive option preferred of the subject invention object.
Figure 3:
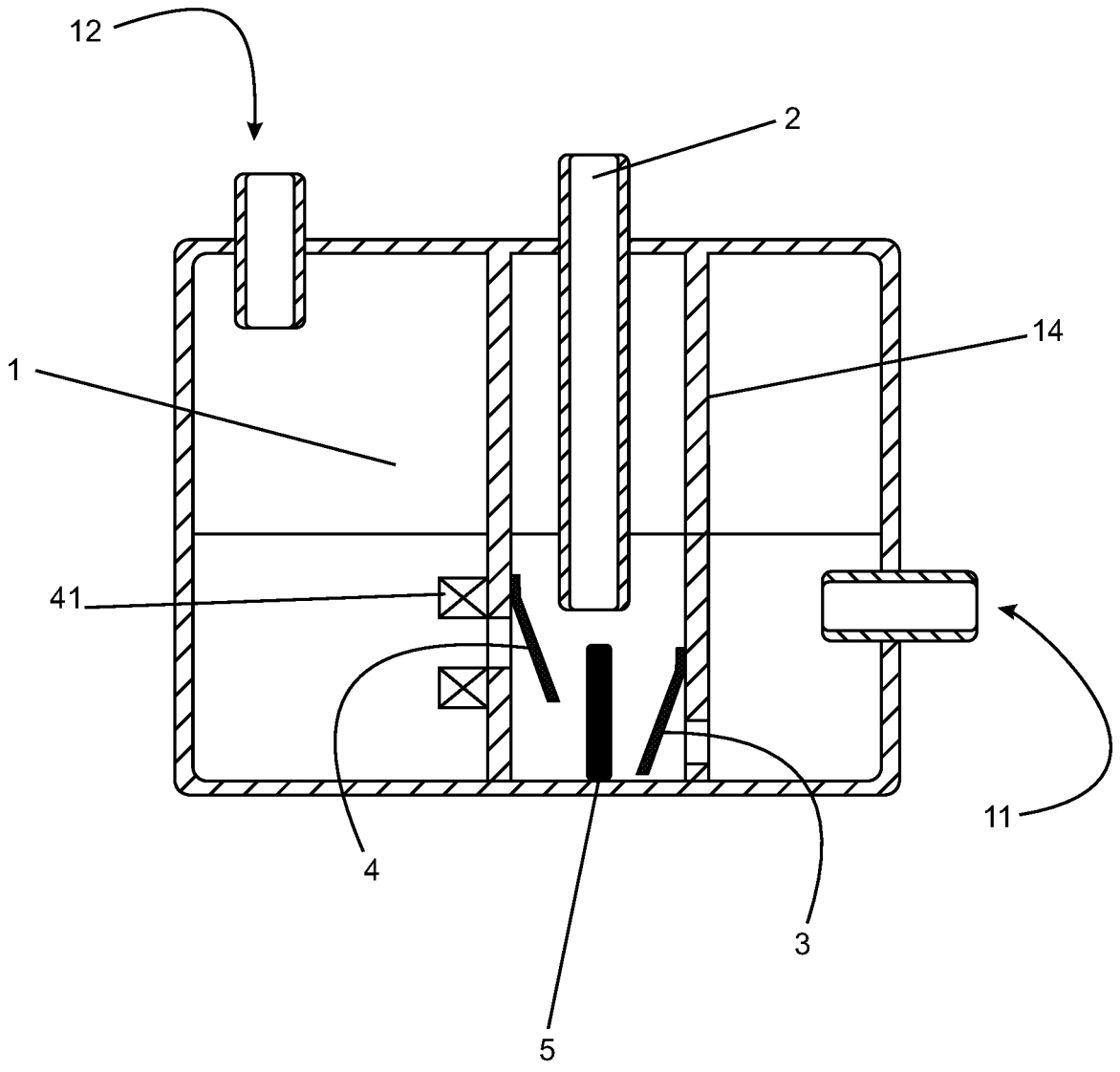
FIG. 3 illustrates in schematic section, a third preferred constructive option of the subject invention object.

According to the mentioned FIGS. 1, 2 and 3, it is found that the acoustic filter suction to reciprocating compressor comprises, broadly, a body (preferably bipartite) whose inner volume is designed to minimize the pulsations suction usually observed in reciprocating compressors used in refrigeration systems. By way of information, as is knowledge of the skilled technicians in the matter, suction filters are preferably compounds in polymer alloy, and so does the suction filter described herein.

According to the present invention, it is noted that the suction acoustic filter described herein comprises a first inlet way 11, a second input track 12 and output track 2. The terms "input" and "output" refers only to the fluid dynamics observed in an acoustic filter suction, which in this case provides for the evaporation gas inlet/suction through the channels 11 and 12, and the outlet of the evaporation gas/suction to the engine compression of the reciprocating compressor, via 2.

As usual, it is expected also a main chamber 1 disposed between the input channels and the output via the acoustic filter. It is exactly in said main chamber 1 which is the attenuation of the suction pulses, and this effect already notoriously described in related technical literature.

In accordance with the subject invention, the flow of fluids that can enter the chamber 1 through the first inlet way 11 is controlled by an automatic valve 3 (previously known valves which open and close automatically when pressure conditions allow, for example, ball valves, check valves, plate valves, among others), while the flow of fluids that can enter the chamber 1 through the second path input 12 is controlled by a one-way valve 4 (valve "ON/OFF"). In this context, it remains clear that both valves 3 and 4 may comprise essentially conventional and commercially available valves, known by technicians skilled in the art.

In the first constructive option of the acoustic filter suction to reciprocating compressor, as shown in FIG. 1, the first inlet means 11 comprises an automatic valve 3 for retention of the spherical type, and the second inlet means 12 comprises a valve a 4 via the electric type, actionable via solenoid command. In this context, and considering the constructive option illustrated in FIG. 1, it remains to emphasize that the automatic valve 3 for retention of the spherical type, could be replaced by an automatic check plate valve type.

In the second constructive option of the acoustic filter suction to reciprocating compressor, as shown in FIG. 2, the first input means 11 comprises an automatic valve 3 preferably open holding plate type in its quiescent state (no forces acting) and second inlet means 12 comprises a one-way valve 4 of the metallic type, actionable through solenoid control 41.

In the constructive possibilities of the acoustic filter illustrated suction in FIGS. 1 and 2 shows that the valves are mounted closely together or juxtaposed with their respective input channels, in which case, the fluid inlet interacts with such valves without first occurs necessarily eases intrinsic pulsations to compressor operation.

In the third constructive possibility suction acoustic filter for reciprocating compressor, as shown in FIG. 3, it is noted, moreover, that the valves are mounted distally of their respective input channels. Therefore, the acoustic filter suction to reciprocating compressor comprises, inside your camera 1, a mounting frame 14 dedicated to the assembly of valves 3 and/or 4. The valves 3 and 4 of this third constructive possibility are similar to valves second constructive option, i.e. the automatic valve 3 is withholding kind plate and preferably open in its resting state (not acting forces) and the one-way valve 4 is of the metallic type, actionable through solenoid control 41.

Still on the constructive possibilities illustrated in FIGS. 2 and 3, it is noted that the automatic valve 3 and/or one-way valve 4 can be of the "normally-open" and/or the type "normal-closed", and, regardless of this constructive detail, it is essential that such valves allow a unique fluid flow. The example of FIG. 3, where both valves are "normally-open", the fluid inlet for the second input path 12 must be able to close the automatic valve 3 for retention and, on the other hand, the controlled closure one way valve 4 through the solenoid actuator 41 must be able to allow the maintenance of opening the automatic valve 3 for retention and, accordingly, the fluid inlet through the first inlet 11. Also in relation to the possibilities construction illustrated in FIGS. 2 and 3, it is seen that preferably at least one of the two valves 3 and 4 cooperates with an end-of-travel stop 5 strategically arranged within the chamber 1 the acoustic filter suction compressor alternative. That end-of-travel stop 5 aims to limit the opening stroke of their respective valve.

In general, the third constructive option of the acoustic filter suction to reciprocating compressor, as shown in FIG. 3, differs from the second constructive option of acoustic suction filter reciprocating compressor, as shown in FIG. 2, by the fact that the mounting frame 14, and allows the valves to be physically disconnected from entryways, has yet to be defined two new independent chambers beyond that common to two lines of pressure and, in addition, makes it possible to use a single stop end-to 5-course for both valves. This configuration aims to reduce the residual volume of fluid in common chamber, allowing the system to operate at higher switching frequencies for the reasons explained on patent PCT/BR2011/000120 and BR1020140072543.

The "outputs" of both valves 3 and 4 are directed to the camera 1, which comprises, by definition, a common volume, and intermediate between the two valves 3 and 4 and the outflow two of said acoustic filter suction.

The functional logic of the suction acoustic filter for reciprocating compressor disclosed herein is simple: the differential pressure existing inside the chamber 1 determines which of the valves is in an active operational state. Therefore, it is necessary that the inlet means of the pressure 12 is always larger than the input via the pressure 11, so that simple operation (change of operational status) of a track 4 the valve is sufficient to switch between fluid communication via inlet 11 and outlet of two or fluid communication via the inlet 12 and the outlet pathway 2.

Thus, it is noted that the functional principle of suction acoustic filter reciprocating compressor disclosed herein is similar to the functional principle of selection of the fluid cooling system described in document U.S. Pat. No. 5,531,078 patenting. In fact, this is exactly the intention of the invention in question, with further optimize aspects for improvement also exist in the cooling system described in patenting document U.S. Pat. No. 5,531,078.

Accordingly, it is the great merit of the subject invention using an acoustic filter suction necessary and usually existing on piston compressors, which, provided with two cooperating operating valves solve the assembly problems and lubricant oil return existing in this document patenting U.S. Pat. No. 5,531,078.

While in Patent document U.S. Pat. No. 5,531,078 a one-way valve is external and the check valve is directly mounted on the pipe where circulates the flow of fluid at high pressure, in the invention in question, both valves are mounted so safe, practical and reliable, even in a modeling element whose characteristics are used to facilitate any type of assembly and mechanical connection.

While in Patent document U.S. Pat. No. 5,531,078 the two suction lines are airtight, culminating in the great lubricant oil return problem (widely known problem for the skilled in the art), the subject invention only one of the evaporation/suction lines needs to be tight, while the other suction line/evaporation can be equalized to the internal pressure of the compressor housing within which the suction acoustic filter is disposed. The evaporation/hermetic suction line (high pressure) is connected to the inlet way 12 of the filter, while the input means 11 is equalized with pressure inside the compressor housing (not shown), a pressure that corresponds to the line evaporation/equalized suction.

Furthermore, the valve 3 is accommodated preferably in the lower suction filter region so that the oil may eventually be housed inside said suction filter during compressor operation to be easily purged to the compressor housing when the valve 3 is open. In fact, a valve "normally-open" to the input means 11 is preferred to allow the suction oil filter purging during the period that the compressor is switched off.

Having described the preferred embodiment of the invention in question, it remains evident that the scope of protection required is not limited to the illustrative figure, but on the set of claims and the possible equivalent means.

The invention claimed is:

1. Suction acoustic filter for reciprocating compressor, the suction acoustic filter comprising:

at least a first inlet way and a second inlet way, at least one outlet way and at least one main chamber disposed between the two first and second inlet ways and the outlet way;

wherein the main chamber comprises an acoustic attenuation volume which is common to the two first and second inlet ways and to the at least one outlet way;

characterized by comprising:

at least one automatic valve cooperatively disposed to the first inlet way of the suction acoustic filter;

at least one one-way valve cooperatively disposed to the second inlet way of the suction acoustic filter; and wherein said automatic valve and said one-way valve are actuated in a selectively alternated manner, in which an opening of the one-way valve defines a closure of the automatic valve, and in which a closure of the one-way valve defines an opening of the automatic valve.

2. Filter, according to claim 1, characterized by the fact that the one-way valve comprises a two position valve for two ways.

3. Filter, according to claim 1, characterized by the fact that the one-way valve is defined by a valve commanded by a solenoid.

4. Filter, according to claim 1, characterized by the fact that the automatic valve is defined by a check valve.

5. Filter, according to claim 1, characterized by the fact that the automatic valve is defined by a pressure differential valve.

6. Filter, according to claim 1, characterized by the fact that the automatic valve is defined by a plate valve, and is normally open at rest.

7. Filter, according to claim 5, characterized by the fact that the suction acoustic filter further comprises at least one path stopper disposed inside the main chamber to cooperate with at least one of the automatic valve or the one-way valve.

8. Filter, according to claim 1, characterized by the fact that the automatic valve is housed on a bottom portion of the suction filter.

9. Filter, according to claim 1, characterized by the fact that the suction acoustic filter further comprises at least one mounting structure disposed inside the main chamber, in which the at least one mounting structure is adapted to allow the assembly thereon of at least one of the two valves.

* * * * *